US006772565B1

(12) United States Patent
Schiltz et al.

(10) Patent No.: US 6,772,565 B1
(45) Date of Patent: Aug. 10, 2004

(54) STAKE IMPACT AND REMOVAL SYSTEM

(76) Inventors: Shawn T. Schiltz, 3692 E. Oxford Ln., Higley, AZ (US) 85236; Michael J. Schiltz, 3692 E. Oxford Ln., Higley, AZ (US) 85236

( * ) Notice: Subject to any disclaimer, the term of this patent is extended or adjusted under 35 U.S.C. 154(b) by 0 days.

(21) Appl. No.: 10/303,519

(22) Filed: Nov. 25, 2002

(51) Int. Cl.[7] ..... E02D 5/74
(52) U.S. Cl. ..... 52/155; 52/156
(58) Field of Search ..... 52/155, 165; 135/118; 144/195.5; 248/156

(56) References Cited

U.S. PATENT DOCUMENTS

| | | | | | |
|---|---|---|---|---|---|
| 2,587,944 | A | | 3/1952 | Williams | |
| 2,774,133 | A | | 12/1956 | Sitz | |
| 2,787,178 | A | | 4/1957 | Maxim | |
| 2,815,692 | A | | 12/1957 | Daniels | |
| 2,903,932 | A | | 9/1959 | McGonagill | |
| 3,071,994 | A | | 1/1963 | Swenson | |
| 3,313,356 | A | * | 4/1967 | Clevenger | 173/91 |
| 3,381,763 | A | | 5/1968 | Matson | |
| 3,519,087 | A | * | 7/1970 | Santi | 173/91 |
| 3,519,234 | A | | 7/1970 | Matson | |
| 3,973,605 | A | | 8/1976 | DeCaro | |
| 4,101,088 | A | * | 7/1978 | Stauth | 242/396.1 |
| 4,261,424 | A | | 4/1981 | Gonterman et al. | |
| 4,350,192 | A | * | 9/1982 | Dent | 144/195.5 |
| 4,429,727 | A | * | 2/1984 | Wilson | 144/195.5 |
| 4,440,370 | A | * | 4/1984 | Rood | 248/75 |
| 4,580,804 | A | | 4/1986 | Weber | |
| 4,589,622 | A | | 5/1986 | Hutter | |
| D299,374 | S | * | 1/1989 | Williams | D21/840 |
| 4,813,494 | A | | 3/1989 | Beard et al. | |
| 4,936,194 | A | * | 6/1990 | Horowitz | 52/155 |
| 4,944,476 | A | * | 7/1990 | Olson | 248/87 |
| 5,085,281 | A | | 2/1992 | Shelly | |
| 5,230,187 | A | * | 7/1993 | Reimann | 52/102 |
| 5,370,192 | A | * | 12/1994 | Evinger | 173/90 |
| 5,542,476 | A | | 8/1996 | Hansen | |
| D377,076 | S | * | 12/1996 | Adams | D21/840 |
| 6,102,135 | A | | 8/2000 | Shaw | |
| 6,527,246 | B1 | * | 3/2003 | Stinnett | 248/545 |

* cited by examiner

*Primary Examiner*—Leslie A. Braun
*Assistant Examiner*—Kofi Schulterbrandt
(74) *Attorney, Agent, or Firm*—Schmeiser, Olsen & Watts

(57) ABSTRACT

A stake system wherein a stake has two hooks extending from the body of the stake for securing items when the stake is driven into the ground. A complimentary impact device is adapted to receive the stake within a sleeve of the impact device for hammering the stake into the ground. A slot and notch within the sleeve can be used to engage one of the hooks for extracting the stake from the ground.

5 Claims, 4 Drawing Sheets

STAKE IMPACT AND REMOVAL SYSTEM

FIELD OF THE INVENTION

Generally, this invention relates to stakes of the type that are driven into the ground. More specifically, this invention is a stake insertion and extraction system that includes stakes and an impact device.

BACKGROUND

Stakes may be driven into the ground to serve a multiplicity of purposes. One of the more common uses is that related to camping wherein stakes are driven into the ground to secure tents, tarps or other items. Due to the fact that camping conditions vary exceedingly, relative to the type of terrain and the ground conditions, the ease or difficulty with which the ground will receive a stake varies greatly. Accordingly, it is difficult to prepare for all the various conditions one may encounter. One of the most common problems encountered is where the ground is extremely hard. This maybe caused due to the dryness of the climate, or where the soil is frozen or very rocky. In these situations, it is usually necessary to carry a hammer or other device for fully inserting the stake into the ground. Where no hammer is available, or if one is forgotten, it is not uncommon to look for a rock or other heavy implement to hammer the stake into the ground.

Accordingly, while a stake may be inserted into the ground with a number of different implements or even with rocks generally found at a camp site, these devices are not designed for removal of the stake. While it is advantageous to insert a stake completely into the ground in order to assure that the item being secured stays in place, this also often guarantees that there will be great difficulty when trying to remove the stake. While hammers and the like are generally also configured for removing nails, they are not designed for stake removal. Accordingly, it is not uncommon to spend a significant amount of time trying to pull the stake out of the ground. To loosen the stake, one may need to shake or hammer it from one side to the other, which is not only time consuming but can also cause the stake to break or become misconfigured and unusable. In some instances, the item being secured is attached to the stake in such a way that it is difficult, if not impossible, to remove the item until the stake has been removed. For example, it is common for there to be a ring or grommet at each corner of a tent through which a stake may be inserted. While the end of the stake may be inserted through the ring or grommet, the top of the stake is usually too large to pass through the opening. Accordingly, the only way to disengage the tent is to remove the stake. Of the stake cannot be removed it may become necessary to cut the stake or break it. Such situations are exacerbate in bad weather conditions and thus the need for a more suitable system for inserting and removing stakes.

SUMMARY OF THE INVENTION

This invention provides an improved stake having hooks which serve the dual purpose of securing a ring, grommet or other item to the ground while also serving as part of an engagement system for removing the stake. The stake also has once embodiment wherein the hooks include an eyelet for tying various items to the stake.

The stake serves to form an integral part of a stake insertion and extraction system which utilizes an impact device. The impact device has a sleeve into which the stake may be inserted. A slot in the sleeve serves to receive the hooks which during insertion move along the slot as the stake is hammered into the ground. A notch extending from the slot allows one of the hooks to secure the stake and impact device together such that the impact device can be used to remove the stake from the ground.

BRIEF DESCRIPTION OF THE DRAWINGS

The foregoing and other features and advantages of the stake impact and removal system will be apparent from the following more particular description of specific embodiments, as illustrated in the accompanying drawings, wherein.

DETAILED DESCRIPTION OF EMBODIMENTS OF THE INVENTION

Figure 1:
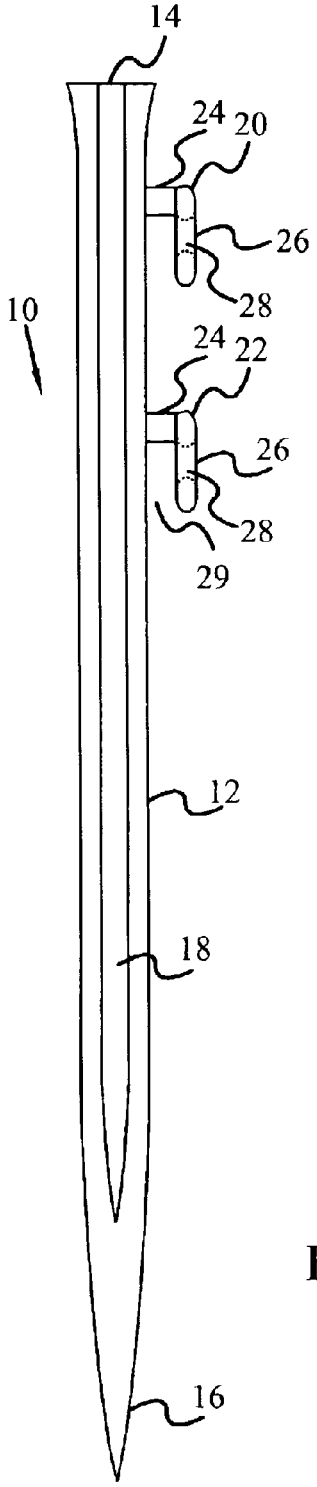
FIG. 1 is a side elevational view of the stake of the present invention.
Figure 1B:
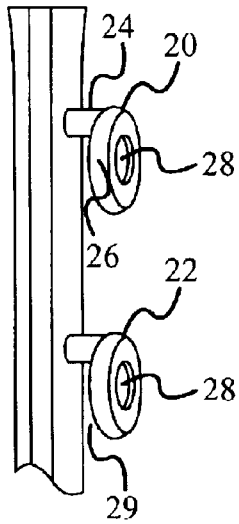
FIG. 1*b* is an elevational view with partial breakaway showing a particular stake hook configuration.

FIGS. 1 and 1*b* disclose a stake 10 having an elongate body 12. The stake 10 has an impact end 14 and opposite thereto a tapered end 16. Along the body 12 of the stake 10 is a bevel 18, which serves to strengthen the stake. Extending outwardly from the stake 10 toward the impact end 14 is a first hook 20. Located a predetermined distance toward the tapered end 16 is a second hook 22. In each of the hooks 20 and 22 there is a first arm segment 24, which extends outwardly from the body of the stake and a second arm segment 26, which extends downwardly from the first arm segment toward the tapered tip 16. In the embodiment shown in FIG. 1, the second arm segments 26 also contains an eyelet 28.

It should be appreciated that the stake may be made of any one of a number of materials including, but not limited to, metal or hardened plastic or any other typical materials used for such purposes. Furthermore, the distance between the hooks 20 and 22 in one embodiment are calculated to coincide with the distance between slot 34 of the impact device and the sleeve end 60 as shown in FIG. 4.

Figure 2:
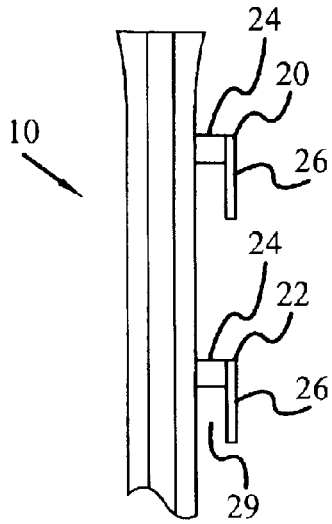
FIG. 2 is an elevational view and partial break away with the partial break away showing an alternate embodiment for the stake hooks.
Figure 3:
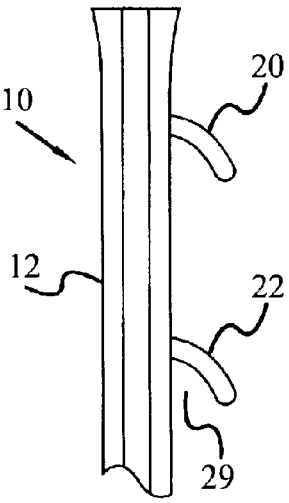
FIG. 3 is an elevational view of an alternate embodiment of the hook configuration.

FIG. 2 discloses an alternate embodiment wherein the stake 10 has hooks 20 and 22 with first and second arm segments that do not contain an eyelet. FIG. 3 discloses another embodiment wherein the hooks 20 and 22 extend outwardly from the body 12 of the stake 10 and are curved downwardly from the body 12 toward the tapered tip 6. It should be appreciated that the thickness of the hooks as well as the length of the hooks may be varied depending upon the intended usage. When fully inserted into the ground, the second arm segment 26 of hook 22 will engage the ground or may even be partially driven into the ground so as to form an additional enclosure designated at 29 which would be bound on one side by the elongate body 12 on the top and on the side opposite the elongate body by the hook 22 and at the bottom by the ground (not shown). The topmost hook 20, however, remains free and after the stake is inserted, hook 20 may be used to attach other items such as a tent rain cover or the like. In addition, since hook 20 does not engage the ground during operation, it is more easily secured into the impact device 30 for removing the stake. By having two hooks 20 and 22 aligned with each other should one of the hooks break or become nonfunctional the stake may still be utilized using only the remaining hook.

Figure 4:
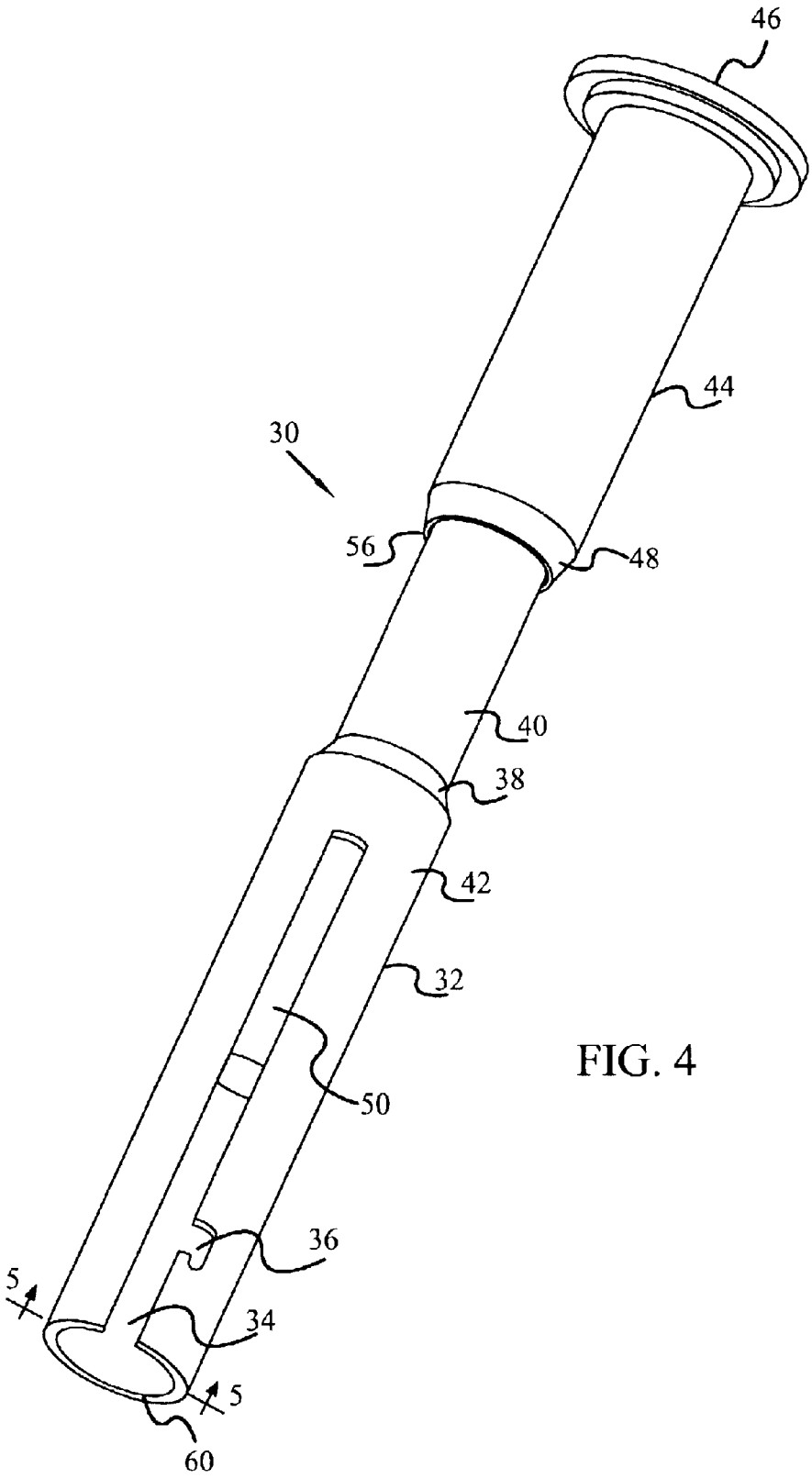
FIG. 4 is a perspective view of the impact device.

FIG. 4 discloses the impact device 30 which has a sleeve 32 which is essentially a tubular barrel. The sleeve 32 contains an elongate slot 34 and extending off of the slot 34 is a notch 36. In one embodiment, as shown in FIG. 4 the notch 36 is "L" shaped. The size of the notch is selected to coincide with the thickness of the first arm segment 24 such that segment 24 fits snugly into the notch. Toward the upper portion 40 of the sleeve 32, the outer dimension of the sleeve is tapered inwardly forming a shoulder 38. The shoulder 38 also narrows the internal diameter of the sleeve.

Slideably mounted on the upper portion 40 is a handle 44. At the top end of the handle 44 is a handle head 46: The lower end of the handle 44 tapers at 48. The handle head 46 broadens out to form an impact surface should it be necessary to engage the handle head with an additional device such as a hammer.

As explained previously, the distance between the notch 36 and the sleeve end 60 is chosen to be less than the distance between the first arm segments 24 of hooks 20 and 22. In this manner, once the stake is driven into the ground and the second hook 22 engages the ground, the stake can be easily extracted by sliding the top of the stake into the sleeve 32 and rotating the impact device to locate segment 24 of hook 20 in slot 36. Upward impact by the handle 44 would then serve to extract the stake from the ground.

Figure 5:
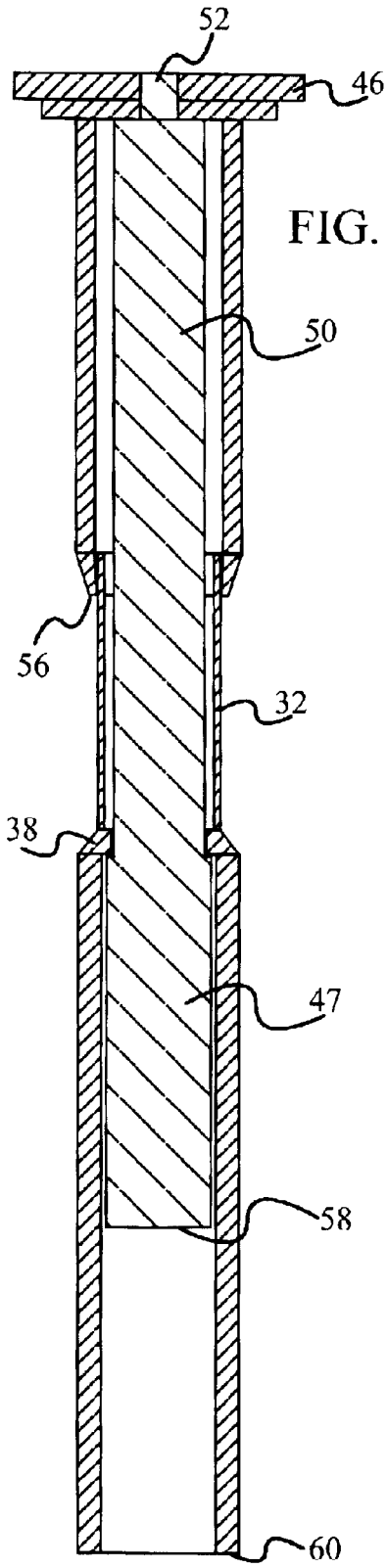
FIG. 5 is a view taken along lines 5—5 of FIG. 4.

As shown in FIG. 5, a hammer rod 50 has a tab 52 which is secured within the handle head 46 so as to fasten the rod 50 to the handle head 46. It should be appreciated that numerous configurations could be used to secure the hammer rod to the handle. For example, the rod could be threaded into the handle head or could be welded or the like. The hammer rod 50 extends from the handle head 46 through the handle 44 and into the sleeve 32. The lower part 47 of rod 50 is of a larger diameter than the internal diameter of the sleeve 32 at the shoulder 38. Thus, when handle 44 is lifted upwardly toward the retracted position the lower part 47 of rod 50 engages the inner surface of sleeve 32 at shoulder 38 preventing the handle and sleeve from separating. Again, it should be appreciated that any one of a number of methods for securing the sleeve to the handle would be acceptable so long as the handle and the sleeve are slideably mounted. As shown in FIG. 5, the handle is in its retracted position and the hammer rod is raised within the sleeve. When the handle is moved to its advanced position, the bottom of the handle head 46 engages the top of the sleeve 32. In this advanced position, the head 58 of the hammer rod is substantially coextensive with the sleeve end 60. By limiting the advanced movement internally, the external surfaces, particularly bottom edge 56 of handle 44 and shoulder 38 stay sufficiently separated to avoid pinching,the user.

Figure 6:
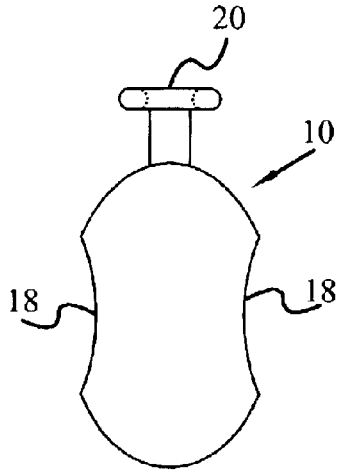
FIG. 6 is a top plan view of the stake of FIG. 1.

FIG. 6 is a top view of the stake 10 and shows the bevels 18 on either side of the stake. Once again, it should be appreciated that virtually any stake body design is suitable so long as it fits within the sleeve and is adapted to receive the hooks in a similar configuration as that shown.

Figure 7:
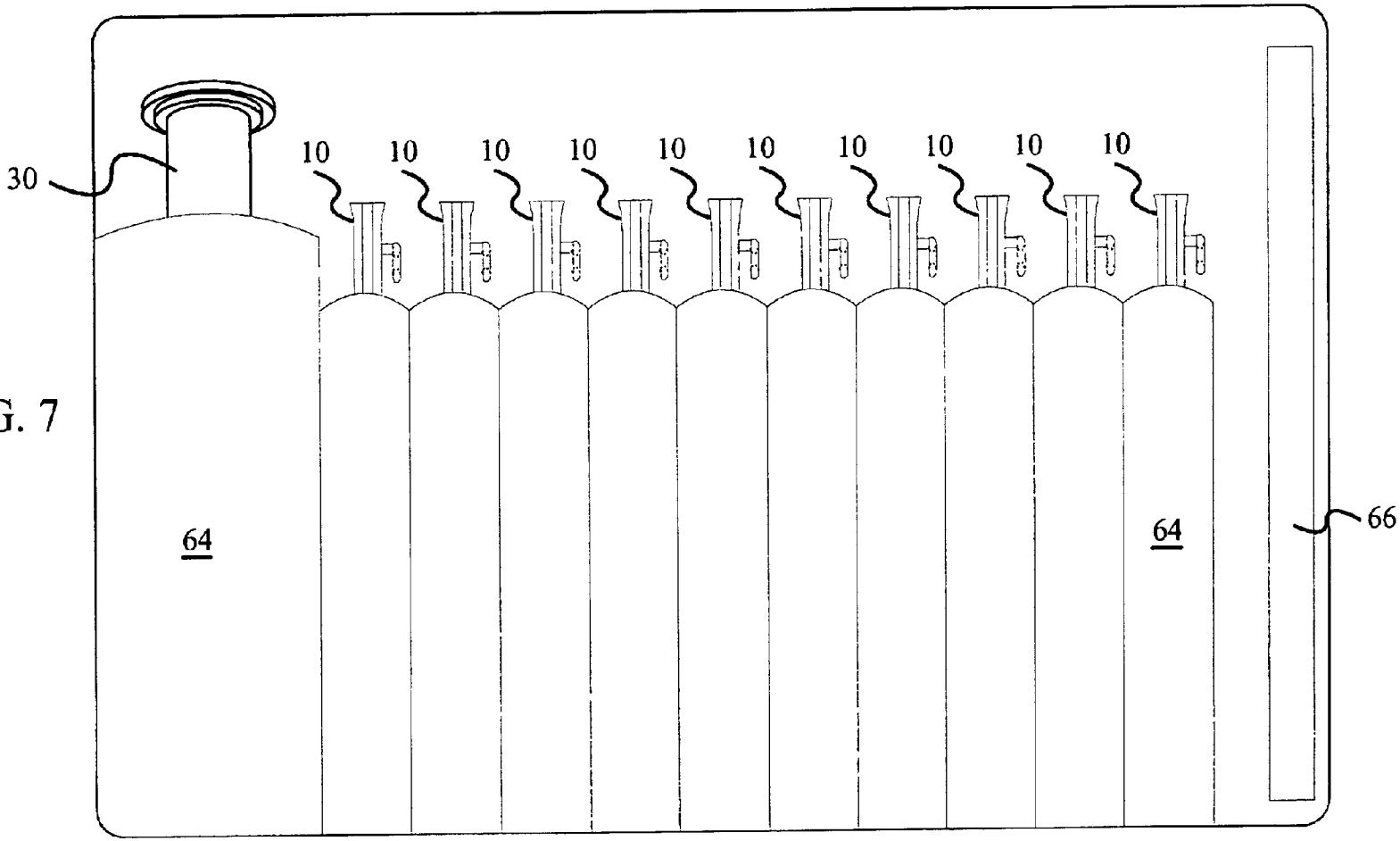
FIG. 7 is an elevational view of a pouch for holding the stake system.

FIG.7 discloses a pouch 62 having a plurality of receptacles 64 for receiving the impact device 30 and a plurality of stakes 10. In one embodiment, the pouch is made of material and may be rolled for easy packing. A velcro strip 66 may be used to engage a series of hooks (not shown) to hold the pouch in its closed position.

In operation, upon selecting where the stake is to be inserted into the ground the user will place a tapered tip 16 against the ground and slide the impact device 30 over the top portion of the elongate body 12 of the stake 10. To accomplish this, the first segments of hooks 20 and 22 will travel freely within the slot 34, which, is located in sleeve 32. The user may grasp the sleeve 32 in one hand and the handle 34 in the other. The handle is then raised to its retracted position as shown in FIGS. 4 and 5 and then quickly moved toward the advanced position thereby driving the hammer rod 50 forward such that the head 58 of the hammer rod engages the impact end 14 of the stake 10. This motion is continued thereby driving the stake into the ground. In one possible usage, the user may temporarily stop driving the stake as the second hook 22 and, in particular, the second arm segment 26 approaches the ground. An item to be secured, such as a hook or grommet, is then secured to the second hook so that a portion of the ring or grommet lies within the enclosure 29. The stake is then further driven into the ground until the second segment 26 of the second hook 22 engages the ground and the grommet, ring or the like is secured within the enclosure 29. Once inserted to its proper depth, the impact device 30 is removed and the user can proceed to the next stake.

When removal is desired, the sleeve 32 of the impact device 30 is slid over the top of the elongate body 12 such that the first arm segment 24 advances along slot 34. The impact hammer is then rotated so that the first hook 20 is moved into the notch 36 which extends from slot 34 in a snug fit. The handle 44 is then moved slowly to its advanced position and quickly moved to the retracted position causing an upward impact, which impacts the arm segment 24 and moves it in an upward direction. This motion is repeated until the stake has been successfully disengaged from the ground.

The above discloses various embodiments of the disclosed invention. However, the scope of the invention is intended to be limited only by the scope of the appended claims.

We claim:

1. A stake and impact system comprising:

an elongate body, said body having a tapered end for insertion into the ground and an impact end for driving said stake;

a first hook extends outward from the stake and downwardly toward the tapered end;

a second hook extending outwardly from the stake and located between the first hook and the impact end; and an impact device comprising:

a sleeve having a stake receiving opening at a first end, said sleeve having an elongate slot for receiving at least one of the first or second stake hooks;

a hammer rod having a first end secured to a handle and a second end slideably located within the sleeve; and said handle being slideably secured to the sleeve for movement between an advanced and retracted position.

2. The invention of claim 1, where a notch extends from said elongate slot and is adapted to receive and at least partially secure at least one of the first or second stake hooks.

3. The invention of claim 2, wherein the distance between the notch and the first end of the sleeve is less than the distance between the first and second hooks.

4. The invention of claim 3, wherein the notch is substantially perpendicular to the elongate slot.

5. The invention of claim 4, further comprising:

a pouch having a plurality of individual receptacles for receiving one or more stakes; and the impact device.

* * * * *